US010989139B2

(12) United States Patent
Bieg et al.

(10) Patent No.: US 10,989,139 B2
(45) Date of Patent: Apr. 27, 2021

(54) CRANKCASE FOR A RECIPROCATING PISTON ENGINE, IN PARTICULAR OF A MOTOR VEHICLE

(71) Applicant: Daimler AG, Stuttgart (DE)

(72) Inventors: Christian Bieg, Aalen (DE); Jochen Haefner, Lorch (DE); Gerold Lehmler, Kirchheim (DE); Marko Possberg, Deizisau (DE); Robert Behr, Wernau (DE); Rainer Joos, Kernen (DE); Daniel Reckinger, Stuttgart (DE); Bernd Schietinger, Esslingen (DE)

(73) Assignee: Daimler AG, Stuttgart (DE)

( * ) Notice: Subject to any disclaimer, the term of this patent is extended or adjusted under 35 U.S.C. 154(b) by 0 days.

(21) Appl. No.: 16/062,975

(22) PCT Filed: Dec. 16, 2016

(86) PCT No.: PCT/EP2016/002124
§ 371 (c)(1),
(2) Date: Jun. 15, 2018

(87) PCT Pub. No.: WO2017/102089
PCT Pub. Date: Jun. 22, 2017

(65) Prior Publication Data

US 2018/0355820 A1 Dec. 13, 2018

(30) Foreign Application Priority Data

Dec. 17, 2015 (DE) ..... 10 2015 016 384.1

(51) Int. Cl.
*F02F 7/00* (2006.01)
*C22C 21/02* (2006.01)
(Continued)

(52) U.S. Cl.
CPC ..... *F02F 7/0039* (2013.01); *B22D 17/20* (2013.01); *B22D 25/02* (2013.01); *C22C 21/02* (2013.01);
(Continued)

(58) Field of Classification Search
CPC .... F02F 7/0012; F02F 2200/06; F02F 7/0085; F02F 7/0007; F02F 7/0004; F02F 7/00; F02F 7/0039; B22D 15/02
See application file for complete search history.

(56) References Cited

U.S. PATENT DOCUMENTS 6,250,368 B1 * 6/2001 Ushio ..... B22D 19/0009 164/133
6,715,458 B1 * 4/2004 Tappen ..... F02F 7/0012 123/195 R
(Continued)

FOREIGN PATENT DOCUMENTS

CN 101220431 A 7/2008
DE 100 26 216 A1 3/2001
(Continued)

OTHER PUBLICATIONS

Machine translation of DE10026216A1 (Year: 2001).*
(Continued)

*Primary Examiner* — Long T Tran
(74) *Attorney, Agent, or Firm* — Crowell & Moring LLP

(57) ABSTRACT

A crankcase for a reciprocating piston engine, in particular of a motor vehicle, includes at least first one wall region that has a greater wall thickness than at least one second wall region of the crankcase that adjoins the first wall region. The crankcase is produced from an aluminum alloy and by at least mainly laminar die casting and is heat-treated completely or heat-treated completely and additionally locally or heat-treated only locally.

20 Claims, 5 Drawing Sheets

(51) Int. Cl.

| | |
|---|---|
| ***B22D 17/20*** | (2006.01) |
| ***B22D 25/02*** | (2006.01) |
| ***C22F 1/043*** | (2006.01) |

(52) U.S. Cl.
CPC ..... *C22F 1/043* (2013.01); *F02F 7/0021* (2013.01); *F02F 2200/06* (2013.01)

(56) References Cited

U.S. PATENT DOCUMENTS

| | | | | |
|---|---|---|---|---|
| 2006/0037566 | A1* | 2/2006 | Sugano | F16C 9/02 123/41.74 |
| 2008/0060723 | A1 | 3/2008 | Doty | |
| 2008/0230032 | A1* | 9/2008 | Koehler | B22D 19/0009 123/193.2 |
| 2010/0012075 | A1* | 1/2010 | Bluhm | F01M 1/02 123/196 R |

FOREIGN PATENT DOCUMENTS

| | | | |
|---|---|---|---|
| DE | 10 2005 051 590 | A1 | 5/2006 |
| EP | 0 554 575 | A1 | 8/1993 |
| EP | 1 170 496 | A1 | 1/2002 |

OTHER PUBLICATIONS

PCT/EP2016/002124, International Search Report dated May 3, 2017 (Three (3) pages).
Chinese Office Action issued in Chinese counterpart application No. 201680074356.7 dated Nov. 5, 2019, with partial English translation (Eleven (11) pages).

* cited by examiner

CRANKCASE FOR A RECIPROCATING PISTON ENGINE, IN PARTICULAR OF A MOTOR VEHICLE

BACKGROUND AND SUMMARY OF THE INVENTION

The invention relates to a crankcase for a reciprocating piston engine, in particular of a motor vehicle.

Crankcases for reciprocating piston engines have long been known from the general prior art and in particular from the field of series vehicle manufacturing. A reciprocating piston engine of this kind is designed for example as a reciprocating internal combustion engine or as an internal combustion engine, and is used in particular to drive a motor vehicle. In the finished manufactured state of the reciprocating piston engine, a drive shaft in the form of a crankshaft of the reciprocating piston engine is mounted on the crankcase so as to be rotatable, relative to the crankcase, about an axis of rotation. The reciprocating piston engine provides torques via the crankshaft, by means of which torques the motor vehicle can be driven, for example.

In this case, the crankcase comprises at least first one wall region that has a greater wall thickness than at least one second wall region of the crankcase that adjoins the first wall region. This design of the crankcase is based in particular on the finding that, during operation of the reciprocating piston engine, stresses of different magnitudes occur in the wall regions. In order to adapt the crankcase to these locally different stresses and at the same time to keep the weight of the crankcase low, the first wall region is designed having a greater wall thickness than the second wall region. In this case, during operation of the reciprocating piston engine, greater stresses occur in the first wall region than in the second wall region, the crankcase being able to withstand the locally different stresses at least substantially without damage and over a long service life, on account of the corresponding design of the wall regions. However, since the second wall region has a smaller wall thickness than the first wall region, the weight of the crankcase can be kept low.

In this connection, it is known from the general prior art to produce a crankcase of this kind by means of permanent mold casting or sand casting. However, permanent mold casting or sand casting methods of this kind are very expensive, and therefore the crankcase can be produced only at high cost. Moreover, what is known as pressure casting is known from the prior art, and is also referred to as squeeze casting. However, a pressure casting method of this kind is also expensive on account of the process. The object of the present invention is therefore that of developing a crankcase of the type mentioned at the outset in such a way that the weight of the crankcase can be kept particularly low, while at the same time achieving particularly low-cost production of the crankcase and at the same time achieving optimized mechanical properties such as strength and/or elongation.

In order to develop a crankcase in such a way that the weight of the crankcase can be kept particularly low, while at the same time achieving particularly low-cost production of the crankcase and at the same time achieving optimized mechanical properties such as strength and/or elongation, in particular in thicker wall regions, according to the invention the crankcase is produced from an aluminum alloy and by means of at least mainly laminar die casting, and is heat-treated. The invention is based in particular on the finding that it is possible in principle to use permanent mold casting or sand casting in order to produce crankcases having stringent requirements with regard to strength and elongation or ductility, but a permanent mold casting or sand casting method of this kind is very expensive. Pressure casting methods can also be carried out only at high cost on account of the process. High strength characteristics and, simultaneously, good elongation characteristics cannot be provided in a satisfactory manner in thick-walled regions, i.e., in wall regions having a very high wall thickness of for example over 15 millimeters, using vacuum die casting methods. Although conventional die casting, during which, in contrast to laminar die casting, the mold is filled in a mainly disordered manner, can be carried out cost-effectively on account of the short cycle time, the crankcase has a relatively high degree of porosity, at least in regions, on account of the method. The porosity severely limits the capacity for heat-treatment, and therefore it is not possible to achieve high strength and elongation values. Strength and elongation values are generally determined in a tensile test, on specimens taken from the component volume.

The porosity in the component can be significantly reduced by using at least mainly laminar die casting. This results in a significantly greater capacity for heat-treatment compared with conventional disordered die casting. As a result, the limits of use of aluminum die casting crankcases can be further extended due to optimized strength and extension properties. In other words, using laminar die casting makes it possible to produce, and in particular to heat-treat, a heat-treated aluminum die casting crankcase having high strength values and/or high elongation values even in thick wall regions, i.e., in wall regions having a large thickness of more than 15 millimeters for example. Furthermore, the use of mainly laminar die casting means that the crankcase can be produced substantially more cost-effectively than when permanent mold casting or sand casting is used. The first wall region of the crankcase is in a bearing block region for example, in which region a drive shaft is rotatably mounted on the crankcase in the finished manufactured state of the internal combustion engine.

It has been found to be particularly when the first wall region is a bearing block region of the crankcase.

The crankcase according to the invention produced by means of mainly laminar die casting can consist, for example, of the following aluminum alloys or based on the following aluminum alloys: AlSi8Cu3, AlSi9Cu3, AlSi7Mg, AlSi10Mg, AlSi12Cu, AlSi17Cu4Mg. The aluminum alloys can each additionally be modified by one or more of the alloying elements iron, magnesium, manganese, copper, zirconium, zinc, titanium, molybdenum, sodium, strontium and phosphorus.

Solution annealing together with subsequent natural and/or artificial aging, and simply at least one process of artificial aging is provided as the at least one heat treatment. In this case, the artificial aging can be carried out immediately after the casting or temporally later, i.e., after natural aging has already been completed. In this case, the artificial aging can be carried out on the entire component and/or just on at least one volume element of the component.

In another embodiment, it is advantageous to carry out the solution annealing treatment not on the entire component but instead in a locally limited manner, on at least one volume element of the component. Following the local solution annealing, subsequent artificial aging can be carried out on the entire component and/or in a locally limited manner, on at least one volume element of the component.

A further embodiment is characterized in that, at least in tensile specimens taken from the center of the first, at least 15 millimeter-thick, naturally and/or artificially aged wall region, the crankcase has strength and elongation values, determined in a tensile test at room temperature, that are characterized by a q-value of on average at least 250, in particular of on average at least 280, and most particularly of on average at least 300. In this case, the q-value is found using the following formula:

$$Q\text{-value}=R_m+150\times\lg(A_5).$$

In this case, RM is the tensile strength, and $\lg(A_5)$ is the decimal logarithm of the elongation $A_5$.

A particularly advantageous embodiment of the invention is characterized in that, at least in tensile specimens taken from the center of the first, at least 15 millimeter-thick, solution-annealed and naturally and/or artificially aged wall region, the crankcase has strength and elongation values, determined in a tensile test at room temperature, that are characterized by a q-value of on average at least 300, in particular of on average at least 350, and most particularly of on average at least 400. In this case, the q-value is found using the following formula:

$$Q\text{-value}=R_m+150\times\lg(A_5).$$

In this case, RM is the tensile strength, and $\lg(A_5)$ is the decimal logarithm of the elongation $A_5$.

A further embodiment is characterized in that, at least in tensile specimens taken from the center of the first, at least 15 millimeter-thick, solution-annealed and naturally and/or artificially aged wall region, the crankcase, produced from a primary aluminum alloy, has strength and elongation values, determined in a tensile test at room temperature, that are characterized by a q-value of on average at least 380 and in particular of on average at least 420. In this case, the q-value is found using the following formula:

$$Q\text{-value}=R_m+150\times\lg(A_5).$$

In this case, RM is the tensile strength, and $\lg(A_5)$ is the decimal logarithm of the elongation $A_5$.

In a further embodiment of the invention, the crankcase comprises at least one cooling jacket through which a coolant can flow and in the region of which the crankcase has a greater wall thickness than in the comparable region of a conventional diecast crankcase.

The coolant is for example a cooling fluid, in particular a gas or a cooling liquid. The cooling liquid is also referred to as cooling water or water, and therefore the cooling jacket is also referred to as a water cooling jacket. For example, during operation of the reciprocating piston engine that is designed as a reciprocating internal combustion engine, the coolant flows through the coolant jacket such that, for example, heat transfer from the crankcase to the coolant can occur. The crankcase is thus cooled. In particular, the coolant jacket surrounds at least one combustion chamber of the crankcase, which combustion chamber is formed as a cylinder for example, at least in part, in particular at least mainly, such that the crankcase can be cooled in particular in the region of the combustion chamber. The crankcase is thus formed as an engine block for example.

Finally, it has been found to be particularly advantageous for the crankcase to comprise reinforcing ribs, the respective wall thicknesses of which are preferably greater than 8 millimeters.

The crankcase according to the invention that is produced in or by at least mainly laminar die casting, may have the following features, and in particular advantages, compared with conventional crankcases that are produced by conventional die casting:

fewer ribs;

the ribs are shorter;

the ribs are substantially thicker;

the ribs have larger radii;

generally greater wall thicknesses or material thickenings, in particular in the region of the coolant jacket, and in this case in particular in the outer region thereof and/or in the region of a hearing block of the crankcase and/or in the region of an oil pan flange of the crankcase;

in the region of the cylinder, an outer contour of the crankcase extends in an at least substantially planar manner, such that there are no radii of curvature in the region;

the laminar die casting or a laminar die casting method is a production method in which for example a flow velocity of the initially fluid aluminum alloy, from which the crankcase is produced, is less than 1.5 meters per second.

These geometry features mentioned above may appear individually or in combination in the crankcase according to the invention.

The above-mentioned ribs are, for example, the previously mentioned reinforcing ribs, by means of which the crankcase is reinforced and thus stiffened, in particular at least locally. A drive shaft of the reciprocating piston engine, which drive shaft is formed as a crankshaft, can be rotatably mounted on the above-mentioned bearing block, such that the crankshaft can be rotatably mounted on the crankcase by means of the bearing block. An oil pan can be flange-mounted on the crankcase, i.e., fastened to the crankcase, by means of the above-mentioned oil pan flange. The oil pan is used in particular during operation of the reciprocating piston engine, in order to collect oil, by forming an oil sump, which oil is used to lubricate and/or cool the reciprocating piston engine. In this case, the oil pan is usually arranged below the bearing block, in the vertical direction of the reciprocating piston engine.

The laminar die casting, by means of which the crankcase according to the invention is produced, is also referred to as a laminar die casting method and is known under the term "Poral casting" for example. In this case, the laminar die casting method is a modified cold-chamber die casting method. The method is carried out on a conventional horizontal cold-chamber die casting machine for example, disorder-free mold filling being sought by means of slow, smooth guidance of the casting piston. Introducing the casting piston into the casting chamber in an at least substantially uniform manner prevents air from swirling the aluminum alloy which is a casting metal and from which the crankcase is produced. Filling the mold smoothly by means of a laminar flow of the casting metal, in the form of a melt, results in cast parts such as the crankcase which are characterized by a particularly lack of pores and can be thermally hardened, welded and dynamically highly loaded.

The main field of application for laminar die casting is usually the field of dynamically highly stressed chassis components. The significant mechanical properties that already exist in the state as cast, on account of the casting method, and that can be further increased by subsequent heat-treatment, are advantageous for the components. It is possible, using this method, to provide and manufacture, in a die casting method, thick-walled cast parts having wall thicknesses of up to 60 millimeters. It should be noted, however, that a minimum wall thickness of 3.8 millimeters is recommended for this method.

As a result of the restrictions with respect to the recommended minimum wall thicknesses, the laminar die casting method is usually not used in the region of the crankcase that is formed as an engine block for example. A plurality of thin-walled regions, in this case in particular the ribbing that is relevant for shape stability and acoustics, should be considered to be critical from the point of view of slow and laminar mold filling. It is generally not possible to simply substitute the casting method, without modifying components and the die. In this case, the main focus in the design is on ensuring laminar mold filling and the possibility of backfeeding during solidification. This results in widenings is the wall thickness in the main flow regions for the purpose of backfeeding, adapted wall thickness transitions in order to prevent turbulence and trapping of air during filling, and significantly more solid gating compared with conventional die casting. Whereas, in conventional die casting, what are known as knife gates are used, which gates are characterized by their small cross sections and are required for rapid mold filling and for accelerating the melt during the mold filling, in the case of laminar die casting the focus is on keeping the feed paths open while the component is solidifying. Keeping the paths open makes it possible to backfeed melt into the cavities of the component, which cavities appear upon solidification, due to the volume contraction of the aluminum, in order to ensure the backfeeding, solid gating is required, because otherwise freezing of the melt in this region would prevent backfeeding of the fluid metal.

Further advantages, features and details of the invention can be found in the following description of preferred embodiments and with reference to the drawings. The features and combinations of features stated above in the description as well as the features and combinations of features stated below in the description of the figures and/or shown in the figures alone can be used not only in the specified combination in each case, but also in other combinations or in isolation without departing from the scope of the invention.

DETAILED DESCRIPTION OF THE DRAWINGS

Identical or functionally identical elements are provided with the same reference signs in the figures.

Figure 1:
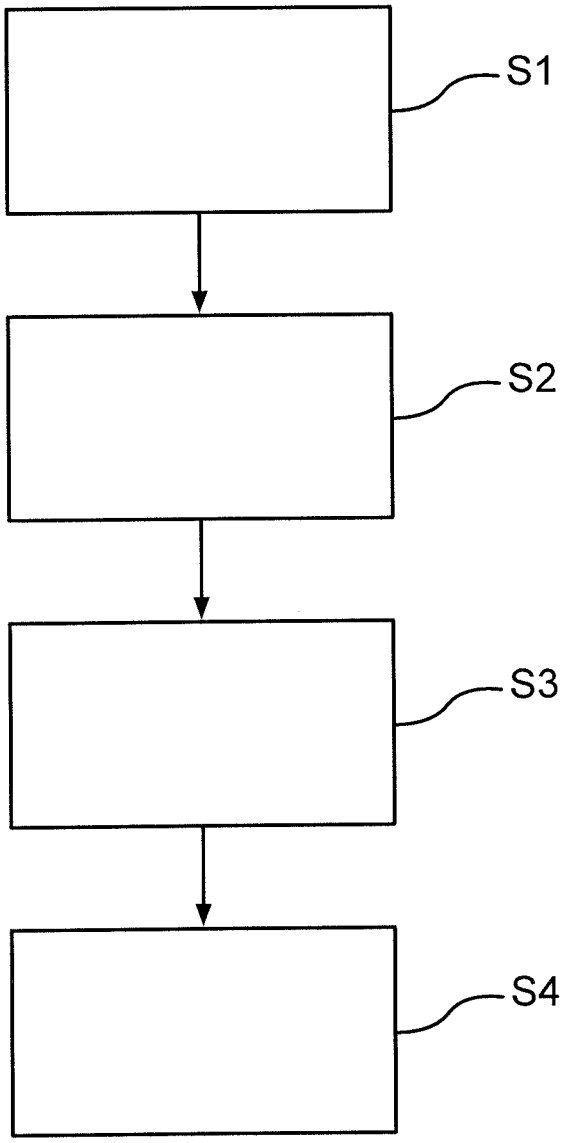
FIG. 1 is a flow diagram for illustrating a basic production path for a crankcase for a reciprocating piston engine comprising at least one first wall region and comprising at least one second wall region that adjoins the first wall region, the first wall region having a larger wall thickness than the second wall region, and the crankcase being produced from an aluminum ahoy and by means of at least mainly laminar die casting, and being heat-treated.

FIG. 1 is a flow diagram for illustrating, in principle, the production path for a crankcase for a reciprocating piston engine. The reciprocating piston engine is, for example, an internal combustion engine, it being possible for the reciprocating piston engine to be a component of a motor vehicle for example. The motor vehicle can be driven by means of the reciprocating piston engine for example. In the finished manufactured state thereof, the reciprocating piston engine comprises a drive shaft in the form of a crankshaft which is mounted on the crankcase so as to be rotatable, relative to the crankcase, about an axis of rotation. The reciprocating piston engine can provide torques via the crankshaft, by means of which torques the motor vehicle can be driven.

In the finished manufactured state thereof, the crankcase comprises at least one first wall region and at least one second wall region that adjoins the first wall region, the first wall region having a greater wall thickness than the second wall region. In other words, compared with the second wall region, the first wall region is a thick-walled region of the crankcase, the wall thickness of the first wall region being greater than 15 millimeters for example. The at least one first wall region may be a bearing block region for example. The wall thickness of the first wall region of at least 15 millimeters means, in other words, that there is at least one volume element in the center of the first wall region that is at a spacing of at least 7.5 millimeters from the next closest component surface.

This design of the wall regions makes it possible to adapt the crankcase to locally different stresses that occur during the operation of the reciprocating piston engine, and in the process to keep the weight of the crankcase as low as possible at the same time. For example, during operation of the reciprocating piston engine, higher stresses occur in the first wall region than in the second wall region. Since the first wall region has a greater wall thickness than the second wall region, the crankcase can also withstand the stresses that occur in the first wall region and are greater compared with the second wall region over a long service life and at least substantially without damage. Since, moreover, the second wall region has a smaller wall thickness than the first wall region, the weight of the crankcase can be kept particularly low.

In order to now produce the crankcase in a particularly cost-effective manner and in order to be able to achieve a particularly low weight of the crankcase, the crankcase is produced from an aluminum alloy and by means of at least mainly laminar die casting, and is heat-treated. Within the context of the production path, for example in a first step S1 a material is provided, from which material the crankcase is produced. In this case, the material is provided in a fluid state, the material being a casting material.

For example one of the following aluminum alloys or a material based on the following aluminum alloys can be used as the material: AiSi8Cu3, AlSi9Cu3, AlSi7Mg, AlSi10 Mg, AlSi12Cu, AlSi17Cu4Mg. The aluminum materials can each additionally be modified by one or more of the alloying elements iron, magnesium, manganese, copper, zirconium, zinc, titanium, molybdenum, sodium, strontium and phosphorus.

In a second step S2 of the production path, the casting material is introduced for example into a mold, in particular a die casting mold, the crankcase being produced from the casting material using the mold. The casting material is an aluminum alloy, and therefore the weight of the crankcase can be kept particularly low. Within the context of a third step S3, the crankcase is produced by means of mainly laminar die casting. After the fluid casting material has been introduced into the mold, the casting material cools and solidifies, whereupon the crankcase can be demolded i.e., removed from the mold, in particular as a raw workpiece. In a fourth step S4, the crankcase or the raw workpiece is finally completely and/or just locally heat-treated in order to achieve particularly advantageous mechanical properties, in particular particularly advantageous strength and elongation properties, of the crankcase.

The heat treatment can be carried out for example by means of solution annealing and subsequent natural and/or artificial aging. The solution annealing treatment can be carried out on the entire component and/or in a locally limited manner. During the production process, following the complete and/or local solution annealing, artificial aging may be carried out on the entire component and/or in a locally limited manner on at least one volume element.

It is also possible for just artificial aging to be carried out, without previous solution annealing. In this case, the artificial aging can be carried out immediately after the casting or after natural aging has already been completed. In principle, it is possible to carry out a plurality of heat-treatment steps on the crankcase. Alternatively or in addition, according to the invention the at least one heat treatment process is also carried out on the entire component and/or just at locally limited regions.

The component can thus be heat-treated completely and, in addition or alternatively, locally. This means, in other words: in an advantageous embodiment, the component can be completely heat-treated in at least one heat-treatment step. In a further embodiment, the component can be heat-treated completely and in addition heat-treated locally at least one point. Furthermore, in a third embodiment, the component can be only locally heat-treated, without being completely heat-treated.

The crankcase is thus a diecast crankcase consisting of an aluminum alloy, the diecast crankcase having particular strength and elongation values in the at least one thick-walled region thereof that is in the form of the first wall region, which strength and elongation values are described by what is known as the q-value.

In this case, in the following, die casting, both disordered and laminar die casting, is understood to be a three-phase method: the three-phase method has a first phase in which a fluid melt is pressed slowly, through the casting piston, out of the casting chamber and into the gate region of the mold. In a second phase of the three-phase method, a closed mold is filled. In this case, the laminar die casting differs from the conventional disordered die casting in that the mold is filled in this second phase in such a way that the melt fills the mold in a substantially turbulence-free or low-turbulence manner. In the third phase of the three-phase method, a high holding pressure is built up in order to carry out backfeeding of the mold.

The term "diecast crankcase" creates a distinction from those crankcases which are produced by means of the permanent mold casting or sand casting method, which method is typically better quality compared with die casting, but also significantly more expensive.

Furthermore, the term "diecast crankcase" creates a distinction from crankcases produced by what is known as thixocasting. In thixocasting, unlike in die casting, inter alia just semi-fluid material is used when filling the mold. In other words, in thixocasting the mold is filled at a comparatively lower temperature and higher pressures than in die casting.

In the squeeze casting process, which is also referred to as pressure casting, the casting mold is designed such that the gating system can bring about effective compression far into the component while the melt is solidifying. This results in highly developed gating systems that are large relative to the component. For this reason, the subsequent compression provided by the casting machine is implemented in the component, by means of the gating system, over a large piston diameter and thus at relatively lower pressure (for example approximately 100 bar). The relatively long process cycle time and the comparatively large proportion of gating material to be recycled make the squeeze casting process uneconomical for producing finer and more complex crankcases. This method is valid in the event, not provided according to the invention, of ceramic or silicon initial bodies needing to be infiltrated with melt during the casting process, since in this case feeding occurs by means of a gating system which, for reasons relating to the method and construction, is advantageously implemented via the thick-walled regions of the bearing block.

The gating system is significantly smaller in the case of conventional disordered die casting and in mainly laminar die casting. The holding pressure provided by the die casting machine is approximately the same in the case of conventional disordered die casting and in mainly laminar die casting. Although the pressure is relatively high in comparison with the squeeze casting process (for example approximately 600 bar to approximately 1000 bar), this reaches only a little way into the component and is used only to maintain the feed, for solidification, against the effective gravity. Subsequent compression deep inside the component is not or barely possible and not necessary on account of the gating system which is small compared to the component, and on account of the cross-sectional jumps from thin-wailed to thick-walled regions in the crankcase. As a result, crankcase designs can be achieved using both conventional disordered die casting and mainly laminar die casting which could not be provided, or could not be provided economically, by a squeeze casting process.

The crankcase according to the invention is based in particular on the finding that thick-walled regions, i.e., the first wall region having a wall thickness of for example over 15 millimeters, cannot be produced by means of vacuum die casting while maintaining high strength and elongation values in the center of the first wall region. As a result, the crankcase according to the invention, which is produced by means of at least mainly laminar die casting, is distinguished from a crankcase produced by means of vacuum die casting.

The high strength and elongation values described by the q-value, even in the thick first wall regions, also bring about a distinction from crankcases produced in the conventional, mainly disordered die casting process. The conventional die casting results in a crankcase which is a cast component and typically has a high porosity, in particular in thick-walled regions, and therefore crankcases produced by means of conventional disordered die casting can be heat-treated only to a limited extent and thus generally have only low strength characteristic values and low elongation characteristic values, the low strength characteristic values and the low elongation characteristic values resulting in a low q-value.

The q-value is found using the following formula:

$$q\text{-value}=R_M+150\times\lg(A_5)$$

In this case, $R_M$ is the tensile strength of the crankcase determined on a specimen in the tensile test, in particular a specimen from the first wall region. Furthermore, $\lg(A_5)$ is the decimal logarithm of the elongation $A_5$ of the crankcase, again determined on a specimen in the tensile test, in particular a specimen from the first wall region. Since very high and/or advantageous strength and elongation values can be achieved by means of the mainly laminar die casting process and heat-treatment, the crankcase has a particularly high q-value and in particular a higher q-value than crankcases produced by means of conventional disordered die casting, in particular also in central regions of the at least one, thick first wall region. Since, according to the invention, it is not provided for a metal mold body, a ceramic mold body or a silicon mold body that is inserted into a mold to also be cast in or for the body to be infiltrated with melt, for example, a q-value of this kind essentially refers to a specimen volume consisting of the aluminum alloy used.

It should be noted, in principle, that the tensile strength and elongation values determined in the tensile test can fluctuate as a result of the structural condition of the specimen and/or the faults in the tensile specimen volume. It is therefore necessary to carry out a plurality of tensile tests on a plurality of components in order to thereby determine an average value both for the tensile strength and for the elongation, in practice, is has been found to be advantageous to select averaging from results from at least 10 individual tensile tests.

The consideration is based on tensile tests carried out at room temperature in each case, for example on tensile specimens or tensile test bars according to DIN 50125.

In this case, it is obvious that the tensile specimens or tensile test bars are solid specimens and hot hollow specimens for example.

When not solution-annealed, following natural and/or artificial aging, the crankcase according to the invention has an average q-value, determined in tensile tests at room temperature, of at least 250, in particular of at least 280, and most particularly of at least 300, at least in the center of the at least one first wall region that has a thickness of at least 15 mm and that is in particular a bearing block region.

When solution-annealed and following natural and/or artificial aging, the crankcase according to the invention has an average q-value, determined in tensile tests at room temperature, of at least 300, in particular of at least 350, and most particularly of at least 400, at least in the center of the at least one first wall region that has a thickness of at least 15 mm and that is in particular a bearing block region.

What is known as a primary aluminum or what is known as a secondary aluminum can be used as the starting material for the mainly laminar die casting. Secondary aluminum is recycled aluminum or recycled aluminum alloys which is/are recovered via the scrap metal cycle for example. The energy expenditure for producing secondary aluminum is significantly lower than that for primary aluminum. However, the previous history means that the secondary aluminum is contaminated with other chemical elements and is therefore of qualitatively lower quality than primary aluminum.

Primary aluminum itself is produced by means of a dry electrolysis method. High-quality products can be produced on account of the high purity of the initial material and the precisely adjustable aluminum alloys thereof, which products are characterized by particularly good strength and/or elongation characteristic values. In other words, particularly high q-values can be achieved using primary aluminum alloys. When a primary aluminum alloy is used, when solution-annealed and following natural and/or artificial aging, the crankcase according to the invention has an average q-value, determined in tensile tests at room temperature, of at least 380 and in particular of at least 420, at least in the center of the at least one first wall region that has a thickness of at least 15 nm and that is in particular a bearing block region.

Producing the crankcase by means of mainly laminar die casting makes it possible, on account of optimized strength and elongation properties, to extend the limits of use of the crankcase formed as an aluminum diecast crankcase. The crankcase is characterized, on account of the production thereof, by a particularly low porosity in particular even in thick wall regions, i.e., in the first wall region. The crankcase can therefore be heat-treated locally within wide limits and/or over the entire component volume. Very high strength and elongation values, and thus a high q-value, can be achieved for the crankcase by means of solution annealing and subsequent artificial aging for example.

Figure 2:
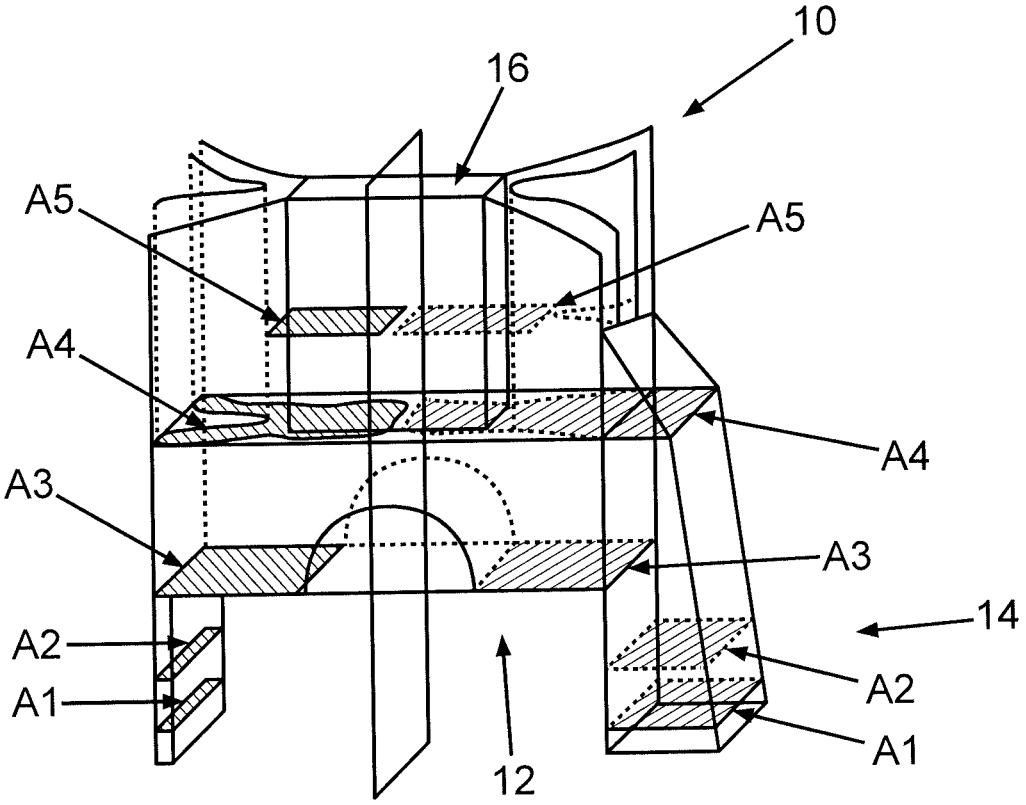
FIG. 2 is a detailed, schematic, perspective front view of the crankcase according to a first embodiment.

A detailed, schematic, perspective front view of the crankcase, already mentioned and denoted overall by 10 in FIG. 2, according to a first embodiment is shown on the right-hand side of FIG. 2 with respect to the image plane. The left-hand side of FIG. 2 shows a design variant of the crankcase 10 which corresponds, for example, to a conventional crankcase produced by conventional die casting. Different cross-sections of the crankcase 10 are denoted A1, A2, A3, A4 and A5 in FIG. 2, which cross-sections are arranged in respective cutting planes and are dented as cross-sectional regions. In this case, the cross-sections A1 and A2 are arranged in the region adjacent to the bearing block 12 of the crankcase 10, it being possible for the above-mentioned drive shaft to be rotatably mounted on the bearing block 12. In particular, the cross-sections A1 and A2 are arranged in the region of what is referred to as a lateral skirt 14 of the crankcase 10. The skirt 14 defines a crank chamber of the crankcase 10 at least in part, for example in the transverse direction of the crankcase 10, the crankshaft being able to be received in the crank chamber at least in part. In the first embodiment, the crankcase 10 is formed in what is known as the long-skirt design, since the lateral skirt 14 is particularly long, in particular in the vertical direction of the crankcase 10, and protrudes downwards significantly beyond the bearing block 12 itself in the vertical direction.

The cross-section in the region of a support surface of the crankcase 10 is denoted A3, at least one bearing cover, formed separately from the crankcase 10, being able to be supported on the crankcase 10, in particular on the bearing block 12, on the support surface. The bearing block 12 and the mentioned bearing cover each form or define in part, in particular half each, a bearing receptacle that is also referred to as bearing bore and in which at least one length portion of the crankshaft can be received. When mounted on the bearing block 12 and thus supported on the support surface, the bearing cover and the bearing block 12 together completely peripherally define the relevant bearing bore in the peripheral direction thereof.

Furthermore, the crankcase 10 for example comprises at least one cylinder 16, shown particularly schematically in FIG. 2, which cylinder is a combustion chamber of the reciprocating piston engine. During ignited operation of the reciprocating piston engine, combustion processes take place in the cylinder 16. The crankcase 10 is thus formed as an engine block for example. In particular, the crankcase 10 comprises a plurality of cylinders that are in succession in the longitudinal direction of the crankcase 10 for example, between which cylinders what is referred to as a cylinder connecting piece is arranged. In this case, A5 for example denotes the cross-section in the region of the cylinder connecting piece, and in particular in the center of the relevant cylinder.

Whereas, for example, the crankcase produced by means of traditional or conventional die casting has huge cross-sectional jumps and a wall thickness jump between the bearing block 12 and the cylinder 16, in particular from cross-section A3 via cross-section A4 to cross-section A5, in the case of the crankcase 10 according to the first embodiment, which crankcase is produced by laminar die casting, contour adaptation is carried out to achieve more homogenous cross-sectional transitions between the gating and the bearing block 12 and between the bearing block 12 and the cylinder connecting piece. In other words, there is a particularly homogenous transition in the wall thickness or the relevant cross-sections between the bearing block 12 and the cylinder 16.

The following, for example, applies for the crankcase produced by means of conventional die casting:

A1<A3 and/or A1<A4

In contrast, the following relationships apply for the laminar diecast crankcase 10 according to the first embodiment and in comparison between the laminar diecast crankcase 10 and the conventionally diecast crankcase according to the first embodiment laminar die casting: A1≥A2≥A3, in particular A1>A2>A3 and/or A1 in conventional die casting<A1 in laminar die casting and/or A4 in conventional die casting<A4 in laminar die casting.

The cross-sections A1 to A5 or the cutting planes are shown in FIG. 3*a* to 4*e*. FIG. 3*a-e* are each cross-sectional views of a conventionally diecast crankcase along the relevant mutually spaced cutting planes which are each spanned, for example, by the longitudinal direction and by the transverse direction of the crankcase. FIG. 4*a-e* are each cross-sectional views of a laminar diecast crankcase 10 along the relevant mutually spaced cutting planes which are each spanned, for example, by the longitudinal direction and by the transverse direction of the crankcase 10.

Figure 3A:
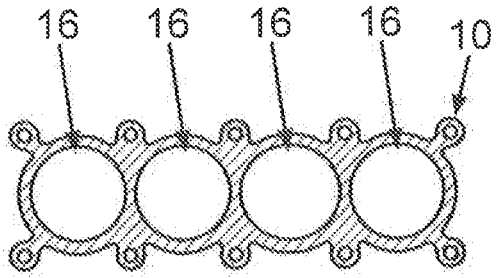
Fig.3A PRIOR ART
FIG. 3*a* is a schematic cross section of a conventionally diecast crankcase in a cutting plane A5 shown in FIG. 2.
Figure 4A:
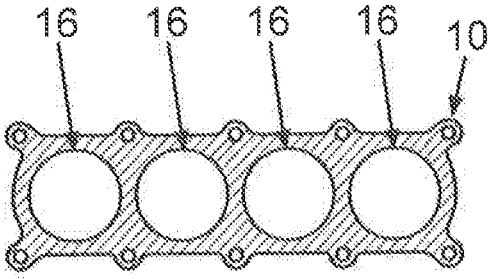
FIG. 4*a* is a schematic cross section of the laminar diecast crankcase in a cutting plane A5 shown in FIG. 2.
Figure 3B:
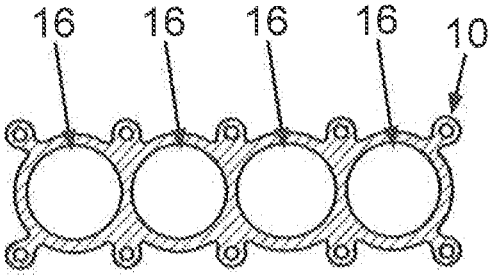
Fig.3B PRIOR ART
FIG. 3*b* is a schematic cross section of the conventionally diecast crankcase in a cutting plane A4 shown in FIG. 2.
Figure 4B:
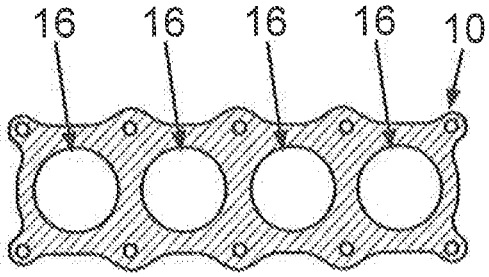
FIG. 4*b* is a schematic cross section of the laminar diecast crankcase in a cutting plane A4 shown in FIG. 2.
Figure 3C:
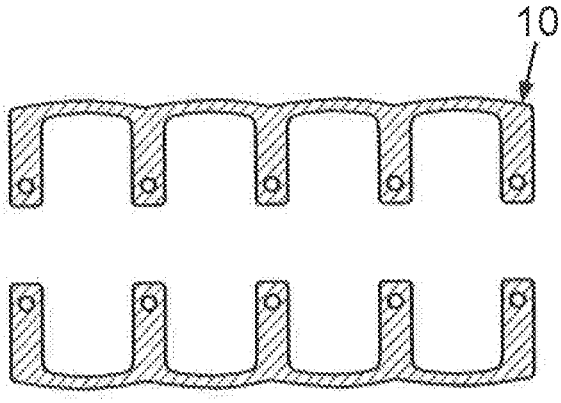
Fig.3C PRIOR ART
FIG. 3*c* is a schematic cross section of the conventionally diecast crankcase in a cutting plane A3 shown in FIG. 2.
Figure 4C:
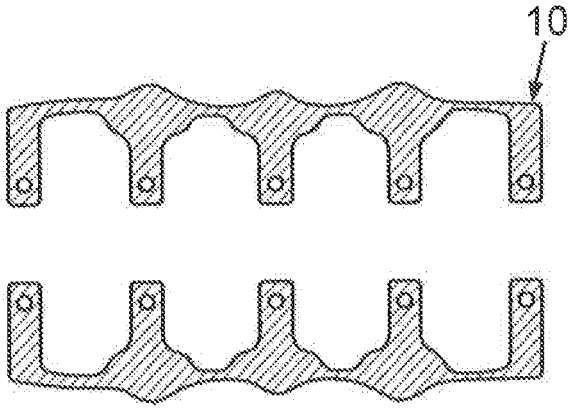
FIG. 4*c* is a schematic cross section of the laminar diecast crankcase in a cutting plane A3 shown in FIG. 2.
Figure 3D:
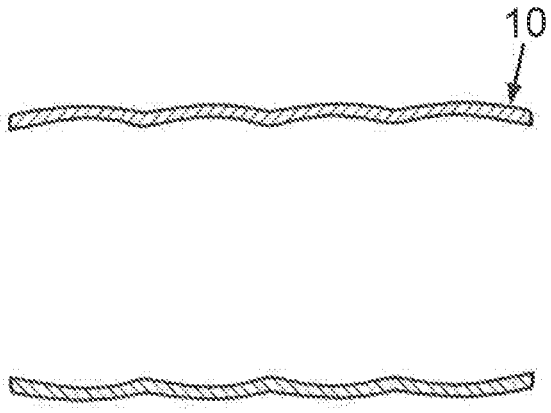
Fig.3D PRIOR ART
FIG. 3*d* is a schematic cross section of the conventionally diecast crankcase in a cutting plane A1 shown in FIG. 2.
Figure 4D:
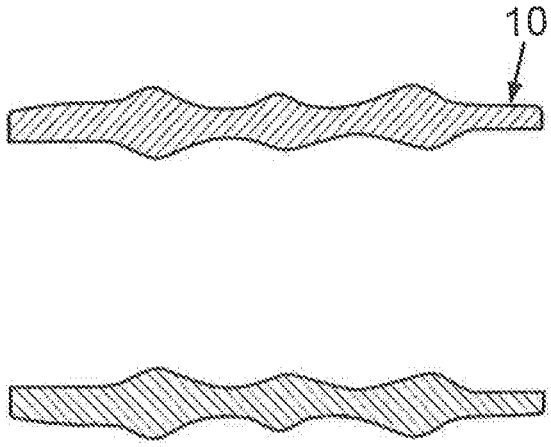
FIG. 4*d* is a schematic cross section of the laminar diecast crankcase in a cutting plane A1 shown in FIG. 2.

The following can be identified schematically in the event of direct cross-comparison of the individual cutting planes:

in the cutting plane A5 the laminar diecast crankcase 10 (FIG. 4*a*) has significant material thickenings compared with the conventionally diecast crankcase (FIG. 3*a*)

in the cutting plane A4, the laminar diecast crankcase 10 (FIG. 4*b*) has significant material thickenings compared with the conventionally diecast crankcase (FIG. 3*b*)

in the cutting plane A3, the laminar diecast crankcase 10 (FIG. 4*c*) has significant material thickenings compared with the conventionally diecast crankcase (FIG. 3*c*)

in the cutting plane A1, the laminar diecast crankcase 10 (FIG. 4*d*) has significant material thickenings compared with the conventionally diecast crankcase (FIG. 3*d*).

These distinguishing features previously shown schematically in FIG. 3*a* to 4*e* can arise both individually and in particular also in combination.

Figure 3E:
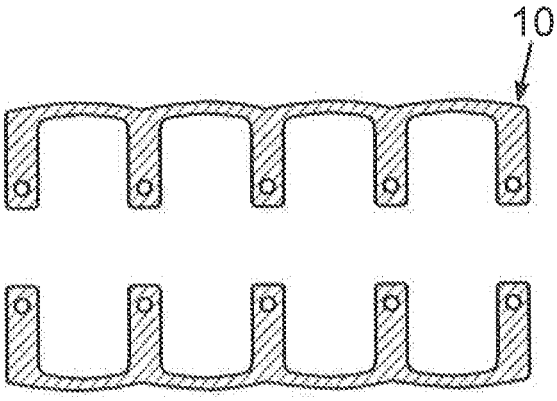
Fig.3E PRIOR ART
FIG. 3*e* is a schematic cross section of the conventionally diecast crankcase in a cutting plane A3 shown in FIG. 2, in the region of the interior of the crankcase.
Figure 4E:
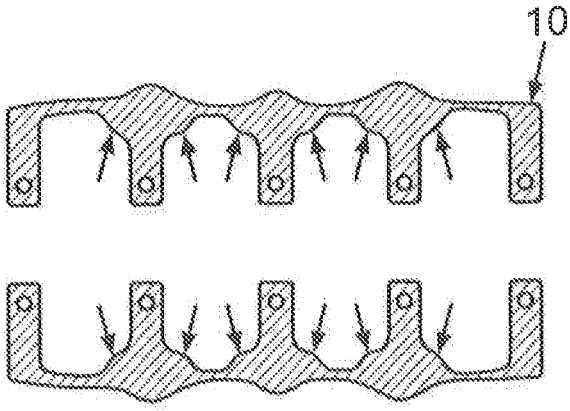
FIG. 4*e* is a schematic cross section of the laminar diecast crankcase in a cutting plane A3 shown in FIG. 2, in the region of the interior of the crankcase.

The features of the above-mentioned geometric properties which distinguish the conventionally diecast crankcase from the laminar diecast crankcase 10 according to the invention primarily define geometry features that can be identified on the outside of the relevant housing. In a further embodiment, the interior of the crankcase 10 additionally or alternatively also has distinguishing geometrical features. This substantive matter is shown in a comparative manner in FIGS. 3*e* and 4*e*. FIG. 3*e* schematically shows the cutting plane A3 of a conventionally diecast crankcase. FIG. 4*e* schematically shows the cutting plane A3 of a laminar diecast crankcase 10. It can be clearly seen that the laminar diecast crankcase 10 has local material thickenings in the interior of the component, as indicated by arrows. The thickenings according to FIG. 4*e* and the thickenings according to FIG. 4*c* in the laminar diecast crankcase 10 can occur both in combination and also individually.

Figure 5:
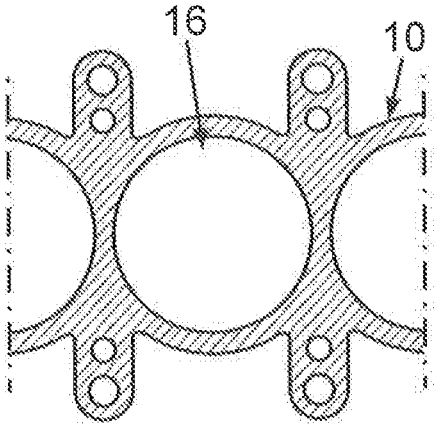
Fig.5 PRIOR ART
FIG. 5 is a schematic view of the conventionally diecast crankcase in the cylinder region thereof, below the water cooling jacket region thereof.
Figure 6:
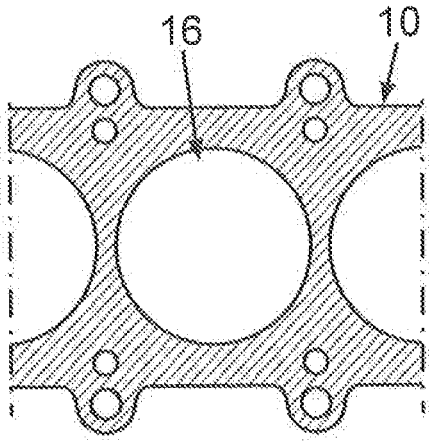
FIG. 6 is a schematic view of the laminar diecast crankcase in the cylinder region thereof, below the water cooling jacket region thereof.

In a further embodiment of the laminar diecast crankcase 10, the crankcase 10 has significant thickenings in the cylinder region, below the water cooling jacket region. This is shown comparatively by FIG. 5 and FIG. 6. FIG. 5 schematically shows the wall thickness ratios of a conventionally diecast crankcase in the cylinder region below the water cooling jacket region. It can be seen, for example, that the contour of the outer wall substantially follows the inner contour of the bore of the cylinder. In comparison, FIG. 6 schematically shows that a laminar diecast crankcase 10 has significant thickenings in the cylinder region, below the water cooling jacket region, as a whole. It can be seen here, for example, that the contour of the outer wall does not follow the inner contour of the bore of the cylinder 16.

Figure 7:
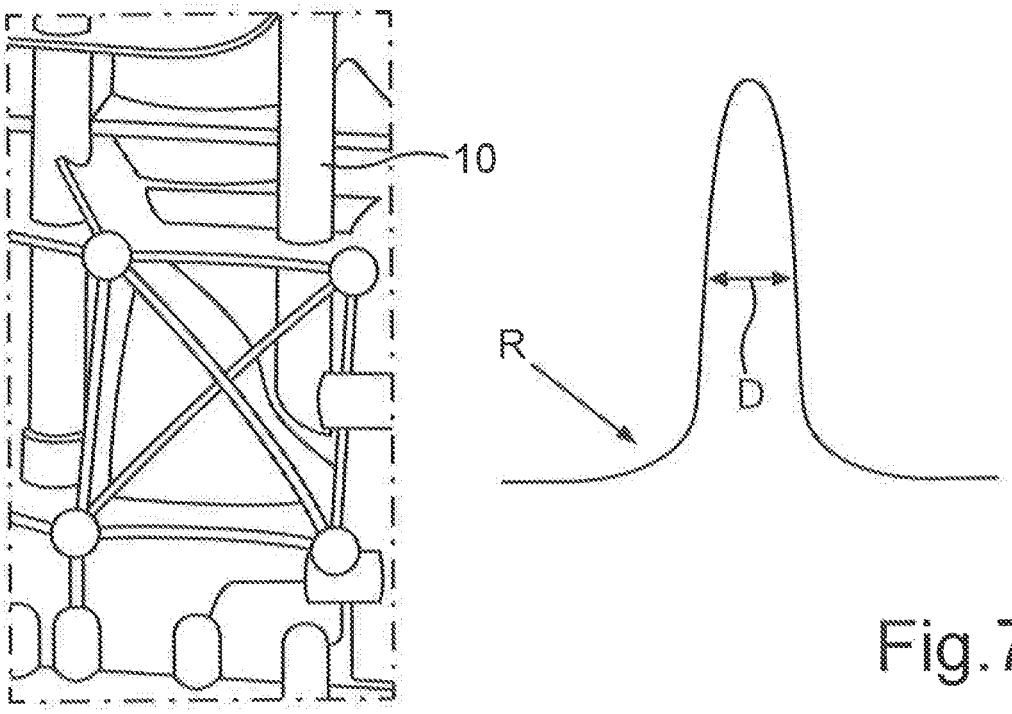
Fig.7 PRIOR ART
FIG. 7 is a schematic view of the conventionally diecast crankcase in the outer region thereof and showing typical ribbing.
Figure 8:
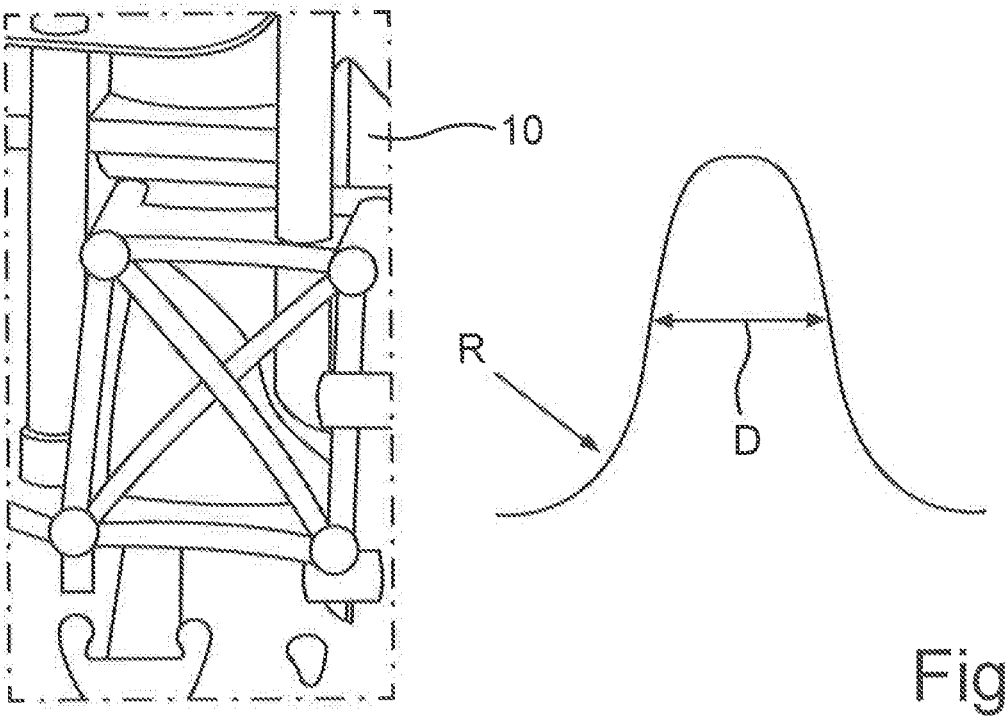
FIG. 8 is a schematic view of the laminar diecast crankcase in the outer region thereof and showing typical ribbing.

In a further embodiment of the laminar diecast crankcase 10, the design of the ribs can also differ from that of a conventionally diecast crankcase. This is shown in FIGS. 7 and 8. FIG. 7 shows the outer region of a conventionally diecast crankcase having a ribbing structure typical thereof. FIG. 8 shows the outer region of a laminar diecast crankcase 10 having a ribbing structure typical thereof. Here, with regard to the ribs, respective wall thicknesses are denoted by D and respective radii are denoted by R. In particular, in comparison with conventional crankcases, it is possible to reduce the number of reinforcing ribs for reinforcing the crankcase 10 and/or to design reinforcing ribs of this kind so as to be shorter and/or substantially thicker, i.e., having substantially greater wall thicknesses, the reinforcing ribs having significantly larger radii for example.

These distinguishing geometrical features between a conventionally diecast crankcase and a laminar diecast crankcase 10, previously shown schematically in FIGS. 3*a* to 8, can arise both individually and in combination.

The invention claimed is:

1. A method of producing a crankcase for a reciprocating piston engine, wherein the crankcase comprises:

a first wall region that has a greater wall thickness than a second wall region that adjoins the first wall region;

and comprising the steps of:

producing an entirety of the crankcase from an aluminum alloy and by laminar die casting, wherein in the laminar die casting:

a flow velocity of fluid aluminum alloy is less than 1.5 meters per second;

a solid gate is used; and the fluid aluminum alloy is backfed via the solid gate into cavities of the crankcase which appear upon solidification of the crankcase; and heat treating the crankcase.

2. The method according to claim 1, wherein a wall thickness of the first wall region is at least 15 millimeters.

3. The method according to claim 1, wherein the first wall region is a bearing block region of the crankcase.

4. The method according to claim 3, wherein in an interior of the crankcase, adjacent to the bearing block region, the crankcase has significant material thickenings compared with a conventionally diecast crankcase.

5. The method according to claim 1, wherein the crankcase is formed of a material based on at least one of aluminum alloys: AlSi8Cu3, AlSi9Cu3, AlSi7Mg, AlSi10Mg, AlSi12Cu or AlSi17Cu4Mg.

6. The method according to claim 5, wherein the aluminum alloy is modified by one or more of alloying elements: iron, magnesium, manganese, copper, zirconium, zinc, titanium, molybdenum, sodium, strontium and phosphorus.

7. The method according to claim 1, wherein the crankcase is heat-treated by solution annealing and/or artificial aging.

8. The method according to claim 1, wherein the crankcase is heat-treated completely or in one or more locally limited regions.

9. The method according to claim 1, wherein at least in tensile specimens taken from a center of the first, at least 15 millimeter-thick, naturally and/or artificially aged wall region, the crankcase has strength and elongation values, determined in a tensile test at room temperature, that are characterized by a q-value of on average at least 250, the q-value resulting from the formula: q-value=$R_m$+150*lg($A_5$), where $R_m$ is tensile strength and lg($A_5$) is a decimal logarithm of elongation $A_5$.

10. The method according to claim 1, wherein at least in tensile specimens taken from a center of the first, at least 15 millimeter-thick, solution-annealed and naturally and/or artificially aged wall region, the crankcase has strength and elongation values, determined in a tensile test at room temperature, that are characterized by a q-value of on average at least 300, the q-value resulting from the formula: q-value=$R_m$+150*lg($A_5$), where $R_m$ is tensile strength and lg($A_5$) is a decimal logarithm of elongation $A_5$.

11. The method according to claim 1, wherein at least in tensile specimens taken from a center of the first, at least 15 millimeter-thick, solution-annealed and naturally and/or artificially aged wall region, the crankcase, produced from a primary aluminum alloy, has strength and elongation values, determined in a tensile test at room temperature, that are characterized by a q-value of on average at least 380, the q-value resulting from the formula: q-value=$R_m$+150*lg($A_5$), where $R_m$ is tensile strength and lg($A_5$) is a decimal logarithm of the elongation $A_5$.

12. The method according to claim 1, wherein the crankcase has at least three cross-sectional regions A1, A2 and A3 that are in succession in a vertical direction of the crankcase and wherein:

A1≥A2≥A3; and/or

A1 produced by conventional die casting<A1 produced by laminar die casting; and/or A4 produced by conventional die casting<A4 produced by laminar die casting.

13. The method according to claim 1, wherein in a cross-sectional region A5, the crankcase has significant material thickenings compared with a conventionally diecast crankcase.

14. The method according to claim 1, wherein in a cross-sectional region A4, the crankcase has significant material thickenings compared with a conventionally diecast crankcase.

15. The method according to claim 1, wherein in a cross-sectional region A3, the crankcase has significant material thickenings compared with a conventionally diecast crankcase.

16. The method according to claim 1, wherein in a cross-sectional region A1, the crankcase has significant material thickenings compared with a conventionally diecast crankcase.

17. The method according to claim 1, wherein in a cylinder region below a water cooling jacket region of the crankcase, a contour of an outer wall substantially follows an inner contour of a bore of a cylinder.

18. The method according to claim 1, wherein on an outside of the crankcase, the crankcase has fewer and/or shorter and/or thicker reinforcing ribs than a conventionally diecast crankcase.

19. The method according to claim 1, wherein the crankcase includes reinforcing ribs and wherein a wall thickness of the reinforcing ribs is greater than eight millimeters.

20. A method of producing a crankcase for a reciprocating piston engine, wherein the crankcase comprises:

a first wall region that has a greater wall thickness than a second wall region that adjoins the first wall region;

wherein a wall thickness of the first wall region is at least 15 millimeters;

wherein the first wall region is a bearing block region of the crankcase;

and comprising the steps of:

producing an entirety of the crankcase from an aluminum alloy and by laminar die casting, wherein in the laminar die casting:

a flow velocity of fluid aluminum alloy is less than 1.5 meters per second;

a solid gate is used; and the fluid aluminum alloy is backfed via the solid gate into cavities of the crankcase which appear upon solidification of the crankcase; and heat treating the crankcase, wherein the crankcase is heat-treated by solution annealing and/or artificial aging.

* * * * *